US009096242B2

(12) United States Patent
Powell et al.

(10) Patent No.: US 9,096,242 B2
(45) Date of Patent: Aug. 4, 2015

(54) GAUGE FACE LUBRICATION

(75) Inventors: Ward Powell, Pittsburgh, PA (US); Charles H. Schnorr, III, Pittsburgh, PA (US); Charles Petrie, Warren, OH (US); Matthew Redfield, Pittsburgh, PA (US)

(73) Assignee: L.B. Foster Rail Technologies, Inc., Pittsburgh, PA (US)

( * ) Notice: Subject to any disclaimer, the term of this patent is extended or adjusted under 35 U.S.C. 154(b) by 352 days.

(21) Appl. No.: 13/593,189

(22) Filed: Aug. 23, 2012

(65) Prior Publication Data

US 2014/0054113 A1 Feb. 27, 2014

(51) Int. Cl.
*B61K 3/00* (2006.01)
*B23P 6/00* (2006.01)

(52) U.S. Cl.
CPC ..... *B61K 3/00* (2013.01); *Y10T 29/4973* (2015.01)

(58) Field of Classification Search
CPC ..... B31K 3/00; B61K 3/00
USPC ..... 184/3.1, 3.2
See application file for complete search history.

(56) References Cited

U.S. PATENT DOCUMENTS

| | | | |
|---|---|---|---|
| 804,787 | A | 11/1905 | Young |
| 1,097,704 | A | 5/1914 | Cassidy et al. |
| 1,205,711 | A | 11/1916 | Clark |
| 1,546,778 | A | 7/1925 | De Niff |
| 1,630,584 | A | 5/1927 | Schneider |
| 1,669,603 | A | 5/1928 | Derrick |
| 1,728,412 | A | 9/1929 | Humphries et al. |
| 1,745,213 | A | 1/1930 | Gray |
| 1,803,923 | A | 5/1931 | Tanner |
| 1,878,259 | A | 9/1932 | Bodkin |
| 1,939,846 | A | 12/1933 | Fenten |
| 1,940,527 | A | 12/1933 | Bolt |
| 1,968,809 | A | 8/1934 | Curtis |
| 1,978,906 | A | 10/1934 | Madison |

(Continued)

FOREIGN PATENT DOCUMENTS

| | | |
|---|---|---|
| CN | 2037746 | 5/1989 |
| CN | 2040059 | 6/1989 |

(Continued)

OTHER PUBLICATIONS

Australian Examination Report No. 1 from Australian Patent Application No. 2009293041 mailed Jun. 20, 2013.

(Continued)

*Primary Examiner* — Michael Mansen
*Assistant Examiner* — Robert T Reese
(74) *Attorney, Agent, or Firm* — Merchant & Gould P.C.

(57) ABSTRACT

A rail gauge face applicator is provided. The gauge face applicator comprises a resilient pad comprising one or more than one channel extending from one or more than one inlet to one or more than one outlet. The one or more than one channel is operable from a closed position when the pressure within the channel is low to an open position when the pressure within the channel is raised. Thus, when the pressure of the friction modifying material is raised the one or more than one channel opens and material can be delivered from the one or more than one outlet. The applicator further comprises a rail engagement element which allows the gauge face applicator to be positioned appropriately to engage a rail. The applicator may be less prone to clogging and may be more efficient at delivering friction modifying material efficiently than prior art applicators.

15 Claims, 6 Drawing Sheets

(56) References Cited

U.S. PATENT DOCUMENTS

| | | | | |
|---|---|---|---|---|
| 1,979,447 | A | 11/1934 | Butcher et al. | |
| 2,018,402 | A | 10/1935 | Humphries et al. | |
| 2,185,810 | A | 1/1940 | Heidenthal | |
| 2,272,774 | A | 2/1942 | McGarry | |
| 2,821,263 | A | 1/1958 | Kerler | |
| 5,348,120 | A | 9/1994 | Junk et al. | |
| 5,394,958 | A | 3/1995 | Junk et al. | |
| 6,009,978 | A | 1/2000 | Chisholm | |
| 6,010,268 | A | 1/2000 | Sereg et al. | |
| 6,401,867 | B1 | 6/2002 | Michioka et al. | |
| 6,742,624 | B2 | 6/2004 | DiCarlo | |
| 6,759,372 | B2 | 7/2004 | Cotter | |
| 6,971,479 | B1 | 12/2005 | Urmson, Jr. et al. | |
| 7,121,383 | B2 | 10/2006 | Kumar et al. | |
| 2002/0056592 | A1 | 5/2002 | Arens et al. | |
| 2004/0050623 | A1 * | 3/2004 | Urmson et al. | 184/3.1 |
| 2008/0047780 | A1 | 2/2008 | Urmson, Jr. et al. | |
| 2008/0083584 | A1 | 4/2008 | Urmson, Jr. et al. | |
| 2008/0223661 | A1 | 9/2008 | Singleton et al. | |
| 2009/0000869 | A1 | 1/2009 | Holland | |
| 2009/0000870 | A1 | 1/2009 | Holland | |
| 2010/0300810 | A1 | 12/2010 | Singleton et al. | |
| 2014/0060972 | A1 * | 3/2014 | Appleby et al. | 184/3.1 |

FOREIGN PATENT DOCUMENTS

| | | |
|---|---|---|
| EP | 1 418 222 | 5/2004 |
| EP | 1807489 | 7/2007 |
| GB | 2 446 949 | 8/2008 |
| JP | 2002-145062 | 5/2002 |
| JP | 2003-276604 | 10/2003 |
| WO | WO 02/25919 | 3/2002 |
| WO | WO 2006/015494 | 2/2006 |
| WO | WO 2010/033900 | 3/2010 |
| WO | WO 2010/033907 | 3/2010 |
| WO | WO 2010/138819 | 12/2010 |
| WO | WO 2014/029028 | 2/2014 |

OTHER PUBLICATIONS

Australian Examination Report No. 1 from Australian Patent Application No. 2010253819 mailed Mar. 21, 2014.
Canadian Office Action from Canadian Patent Application No. 2,622,561 mailed Mar. 26, 2014.
Chinese Office Action from Chinese Patent Application No. 201080031049.3 mailed Dec. 2, 2013.
Chinese Office Action from Chinese Patent Application No. 200980137073.2 mailed Dec. 20, 2013.
Chinese Office Action from Chinese Patent Application No. 200980137073.2 mailed Apr. 23, 2013 (English translation).
Chinese Office Action from Chinese Patent Application No. 2010800310493 issued Jul. 14, 2014 (English translation).
Extended European Search Report from European Patent Application No. 09815329.9 mailed Dec. 5, 2013.
Final Office Action from U.S. Appl. No. 13/935,019 mailed Apr. 29, 2014.
International Search Report and Written Opinion from International Application No. PCT/CA2013/050654 mailed Oct. 18, 2013.
International Search Report and Written Opinion from International Application No. PCT/US2010/036582 mailed Dec. 28, 2010.
Non-Final Office Action from U.S. Appl. No. 12/788,971 mailed Jun. 19, 2014.
Non-Final Office Action from U.S. Appl. No. 13/935,019 mailed Nov. 14, 2013.
Notice of Allowance from U.S. Appl. No. 13/063,553 mailed Mar. 6, 2014.
Associate's Translation of Chinese Office Action from Chinese Patent Application No. 200980137073.2 issued Jun. 5, 2014.
Final Office Action for U.S. Appl. No. 12/788,971 mailed Mar. 14, 2013.
Non-Final Office Action for U.S. Appl. No. 12/788,971 mailed Nov. 27, 2012.
Restriction Requirement Office Action for U.S. Appl. No. 12/788,971 mailed Oct. 12, 2012.

* cited by examiner

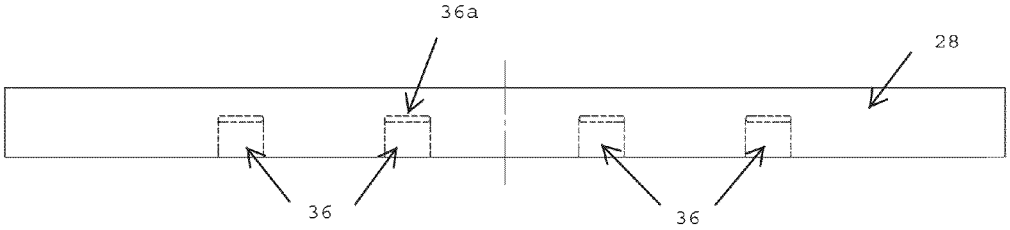
Figure 4A
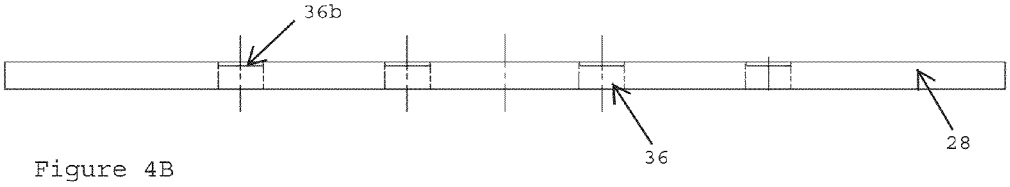
Figure 4B
Figure 4C
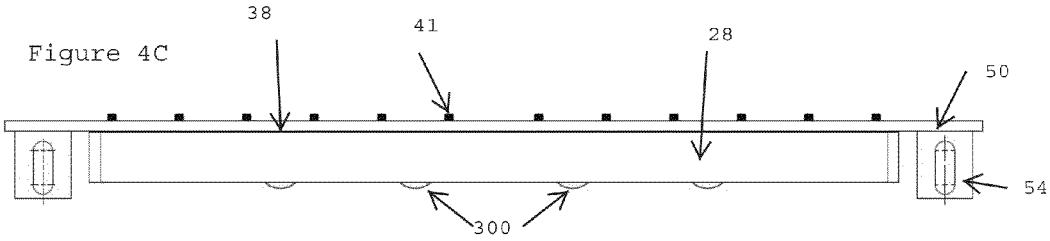
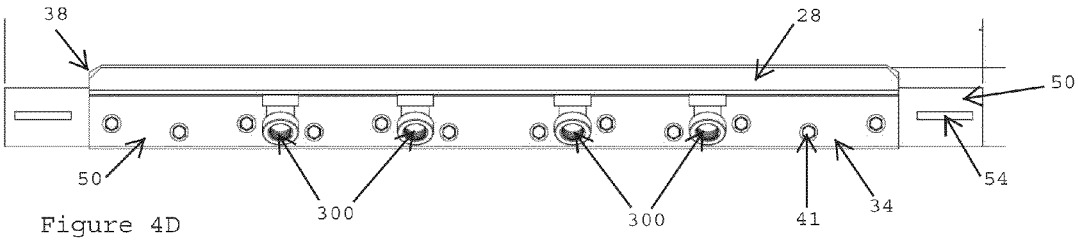
Figure 4D

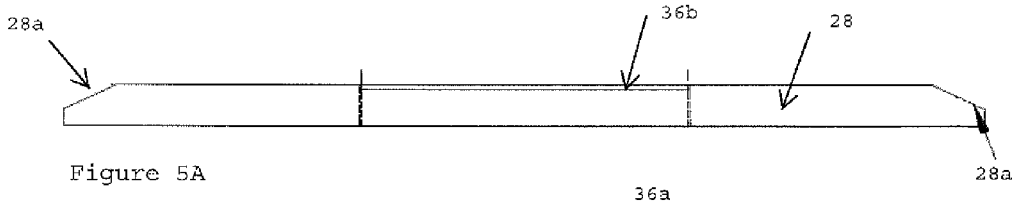
Figure 5A
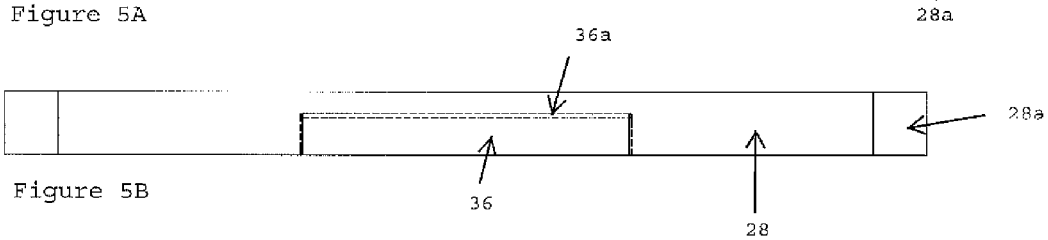
Figure 5B
Figure 5C
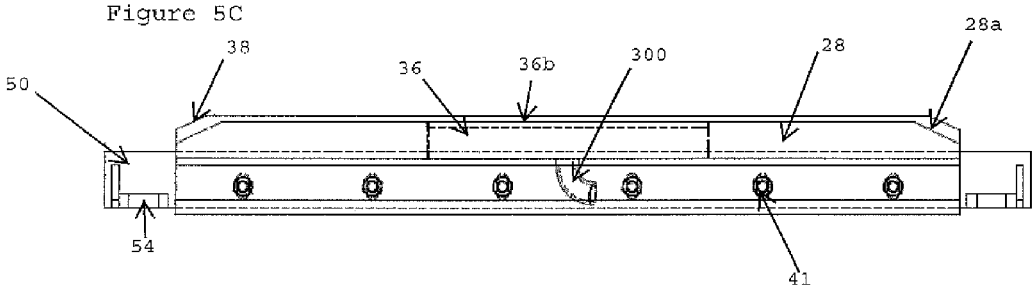
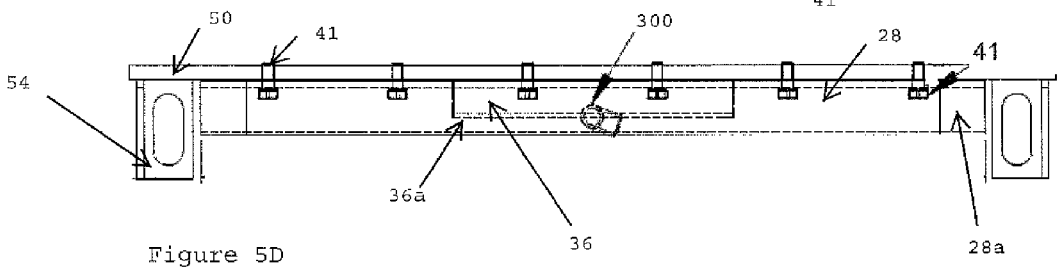
Figure 5D

GAUGE FACE LUBRICATION

TECHNICAL FIELD

The present disclosure pertains to an apparatus and methods for applying lubricants or other friction modifiers to the gauge face of railroad rails.

BACKGROUND

In the operation of railroads, grease or other friction modifiers are applied onto railroad rails, such as to the top of rails or gauge face of rails at curves, turnouts, switches, in some cases, the sections of the track immediately before a switch, and periodically spaced along the length of the track. Such lubricants and friction modifying materials can either reduce or increase the friction where necessary to improve train performance, reduce wheel squeal, reduce wear on both the rails and the train wheels, or a combination thereof. Devices and methods for applying friction modifying materials to top of rail or gauge face rail surfaces include, for example, US 2008/0223661; GB 2,446,949; U.S. Pat. Nos. 2,821,263; 5,348,120; 5,394,958; 6,009,978; 6,742,624; 7,121,383; WO 2010/033900; WO 2010/138819 (these documents are herein incorporated by reference).

Rails have a head portion, a base portion, and a web portion extending between the head portion and the base portion. The head portion defines an outer surface comprising a top surface a field facing surface, and a gauge face surface. Lubricant or other friction modifying material may be applied to the top of rail, gauge face surface, or to both surfaces, as these locations contact the train wheels. However, the material may not always reach the desired location which can reduce the efficacy of friction modification. The material may also be wasted by dripping or flowing to a location where it does not perform its function optimally. The presence of this waste friction modifying material can cause undesirable safety, maintenance, or environmental issues. Apparatus for application of material can be prone to clogging or otherwise being impaired in their performance due to an accumulation of dirt or other residue.

SUMMARY

The present disclosure pertains to an apparatus and methods for applying lubricants or other friction modifiers to the gauge face of railroad rails.

Embodiments of the present disclosure provide a rail gauge face applicator comprising, a pad or body, for example a resilient pad or body, comprising one or more than one channel extending from one or more than one inlet to one or more than one outlet. The one or more than one channel is operable from a closed position when the pressure within each of the one or more channels is low to an open position when the pressure within each of the one or more channels is raised. Thus, when the pressure of the friction modifying material is raised each of the one or more channels opens and material can be delivered from the one or more outlets to the gauge face surface of a rail. The applicator also comprises a rail engagement element which may facilitate positioning the gauge face applicator to engage a gauge face surface of the rail. The resilient pad when mounted against the rail engagement element is compressed so that at least a portion of each of the one or more than one channel within the resilient pad is closed. The portion of each of the one or more channels that is closed may be the outlet or a portion of the channel adjacent the outlet. For example, the resilient pad may be compressed from between about 0.5% to about 20% along a first width, a second width or a combination thereof, of the resilient pad. The width that is compressed may be the first width between one side surface to a second side surface of the resilient pad, the second width between a top surface to a bottom surface of the resilient body, or a combination thereof. The resilient foam bar may comprise, for example from between 1 to about 24 channels, inlets and outlets.

The rail engagement element may also be positioned to extend beyond a top surface of the resilient pad. For example the rail engagement element may extend beyond the top surface from between about 0.01 to about 50 mm. The positioning of the rail engagement element beyond that of the top surface of the resilient pad may facilitate direction of the friction modifying material from each of the one or more outlets to the gauge face surface of the rail. Furthermore by extending the rail engagement element beyond the top surface of the resilient body the resilient pad of the applicator may be positioned at a location along the gauge face surface of the rail that is lower (relative to the ground surface) than would otherwise be possible if the rail engagement element is not present, while still effectively delivering friction modifying material to the gauge face surface.

The use of the rail engagement element may also simplify mounting and adjustment of the assembled applicator against rails comprising worn gauge face or top of rail surfaces, while still achieving effective delivery of the friction modifying material to the gauge face of the rail with reduced waste.

The gauge face applicator may further comprise one or more than one port in fluid communication with the one or more than one inlet so that each of the one or more than one channel is in fluid communication with one or more than one port. Each of the one or more ports may also be connected to, and be in fluid communication with, a friction modifying delivery system. The one or more than one port may be mounted on an applicator support positioned along a bottom surface of the resilient foam bar. The applicator support configured to permit attachment of the gauge face applicator to a rail or rail bed.

The gauge face applicator as described herein may be less prone to clogging and more efficient at delivering friction modifying material efficiently than prior art applicators thereby saving costs associated with friction modifying material, reducing waste of the material, and reducing rail maintenance.

Embodiments of the present disclosure provide a gauge face applicator comprising a compressible foam bar and a rail engagement element, the bar having a one or more inlets, one or more outlets, and one or more channels extending from the one or more inlets to the one or more outlets, the bar compressed against the rail engagement element such that each of the one or more channels is closed to significant flow of friction modifying material but that increasing the flow pressure of the friction modifying material causes one or more of the one or more channels to open and friction modifying material to flow onto a gauge face surface of a rail. The rail engagement element may be positioned to extend beyond a top surface of the resilient pad as described above. The assembled applicator may be easily installed and adjusted as a modular unit simplify mounting and adjustment of the assembled applicator against rails. As noted above, the applicator may also be installed against rails comprising a worn gauge face or top of rail surfaces, while still achieving effective delivery of the friction modifying material to the gauge face of the rail with reduced waste. The gauge face applicator may further comprise one or more ports in fluid communication with the one or more inlet. The one or more port may also be connected to, and be in fluid communication with, a friction modifying delivery system. The one or more port may be mounted on an applicator support positioned along a bottom surface of the resilient foam bar. The applicator support configured to permit attachment of the gauge face applicator to a rail or rail bed. The resilient foam bar may comprise for example, from between 1 to about 24 channels, inlets and outlets. Each of the one or more than one inlets in fluid communication with one or more than one port.

Embodiments of the present disclosure provide a use of a gauge face applicator as described herein for delivering friction modifying material to a gauge face surface of a rail.

Embodiments of the present disclosure also provide a method of applying friction modifying material to a gauge face of a rail, the method comprising providing a gauge face applicator positioned against the gauge face surface, the applicator comprising a resilient pad and a rail engagement element, the resilient pad having one or more friction modifier flow channels extending from one or more inlets to one or more outlets the resilient pad compressed against the rail engagement element so that at least a portion of each of the one or more friction modifier flow channels within the resilient pad is closed when a fluid pressure within the friction modifier flow channel is low; and applying friction modifying material to the gauge face surface of a rail by raising the fluid pressure in one or more of the one or more friction modifier flow channels causing the one or more friction modifier flow channels to open and friction modifying material to be distributed to from the outlet to the gauge face of the rail. The portion of the friction modifier flow channel that is closed may be the outlet, or a portion of the friction modifier flow channel adjacent the outlet.

Embodiments of the present disclosure provide a rail gauge face applicator comprising, a resilient pad attached to an applicator support along a bottom surface of the resilient pad, and a rail engagement element, the resilient pad comprising one or more channels extending from one or more inlets at the bottom surface or a first side surface, to one or more outlets at a top surface or a second side surface adjacent the top surface, each of the one or more channels in fluid communication with one or more port within the applicator support, the applicator support for attachment to the rail or rail bed, the one or more outlet operable from a closed position when low fluid pressure is present in each of the one or more channels, to an open position when the fluid pressure increases within one or more of the one or more channel, the rail engagement element adjacent the second side surface of the resilient pad. The resilient pad, when mounted against the rail engagement element, is compressed so that at least a portion of one or more of the one or more channel within the resilient pad is closed. The portion of the channel that is closed may be the outlet or a portion of the channel adjacent the outlet. For example, the resilient pad may be compressed from between about 0.5% to about 20% along a first width, a second width or a combination thereof, of the resilient pad. The width that is compressed may be the first width between the first side surface to the second side surface of the resilient pad, the second width between the top surface to the bottom surface of the resilient body, or a combination thereof. The rail engagement element may also be positioned to extend beyond the top surface of the resilient pad. For example the rail engagement element may extend beyond the top surface from between about 0.01 to about 50 mm. The positioning of the rail engagement element beyond that of the top surface of the resilient pad may facilitate direction of the friction modifying material from the friction modifying outlet to the gauge face surface of the rail. The one or more port may also be connected to, and be in fluid communication with, a friction modifying delivery system.

The present disclosure also provides a resilient pad cassette comprising a resilient pad comprising one or more than one channel extending from one or more than one inlet to one or more than one outlet, the resilient pad attached to an attachment plate, the attachment plate defining one or more than one opening in fluid communication with the one or more than one inlet. The attachment plate comprising one or more than one attachment mechanism for attaching the resilient pad cassette to the support.

The present disclosure also provides a method of replacing a resilient pad of the gauge face applicator as defined above comprising, removing the resilient pad from the applicator support and the rail engagement element and, compressing a resilient pad cassette, comprising a replacement resilient pad attached to an attachment plate against the rail engagement element, and attaching the attachment plate to the applicator support thereby replacing the resilient pad.

By extending the rail engagement element beyond the top surface of the resilient body the resilient pad of the applicator may be positioned at a location along the gauge face surface of the rail that is lower (relative to the ground surface) than would otherwise be possible if the rail engagement element is not present, while still effectively delivering friction modifying material to the gauge face surface. The use of the rail engagement element may also simplify mounting and adjustment of the assembled applicator against rails comprising worn gauge face or top of rail surfaces, while still achieving effective delivery of the friction modifying material to the gauge face of the rail with reduced waste.

The gauge face applicator as described herein provides a simple design with few parts. Furthermore, using a reduced number of outlets, for example from about 1 to about 10 outlets, assists in keeping the friction modifying material flowing uniformly through the delivery system. As the one or more outlets within the resilient pad of the applicator are closed when the fluid pressure within the one or more channels is low, the outlets self-clean and reduce contaminants from entering the outlets thereby reducing clogging. This may permit the use of additional outlets, for example from about 10-60 outlets, along the resilient foam bar while reducing the incidence of clogging within the outlets.

As used herein, the term "friction modifying material" refers to material which can functionally change the amount of friction between a rail and a wheel and are well known in the art. The material may increase or decrease the amount of friction depending on the particular material and circumstances. Examples of friction modifying materials include but are not limited to those described in WO0225919, EP1418222, EP1807489, U.S. Pat. No. 6,759,372 (which are incorporated herein by reference).

As used herein, the term "rail engagement element" may take any suitable form such as a thin blade that sits flush against the gauge face of the rail.

As used herein, directional terms such as "top", "bottom", "left", "right", "front", and "rear" are used in the following description for the purpose of providing relative reference only, and are not intended to suggest any limitations on how any article is to be positioned during use, or to be mounted in an assembly or relative to an environment.

This summary does not necessarily describe all features of the invention. Other aspects, features and advantages of the invention will be apparent to those of ordinary skill in the art upon review of the following description of specific embodiments of the invention.

BRIEF DESCRIPTION OF THE DRAWINGS

The present disclosure will be described in conjunction with reference to the following drawings in which:

FIG. 4A shows a top view of a non-limiting example of a resilient pad comprising four channels. FIG. 4B shows a back view of the resilient pad of FIG. 4A. The outlets of the channels are shown on a surface of the resilient pad. FIG. 4C shows a top view of a several components of an example of an applicator, including a non-liming example of a resilient pad, a rail engagement element, a support, and four ports. FIG. 4D shows a front view of the components of the applicator shown in FIG. 4C.

FIG. 5A shows a back view of a non-limiting example of a resilient pad comprising one elongate channel. An outlet is shown on a surface of the resilient pad. FIG. 5B shows a top view of the resilient pad of FIG. 5A. FIG. 5C shows a front view of a several components of an example of an applicator, including a non-limiting example of a resilient pad, a rail engagement element, a support, and one port. FIG. 5D shows a top view of the components shown in FIG. 5C.

DETAILED DESCRIPTION

The present disclosure pertains to an apparatus and methods for applying lubricants or other friction modifiers to the gauge face of railroad rails.

Figure 1:
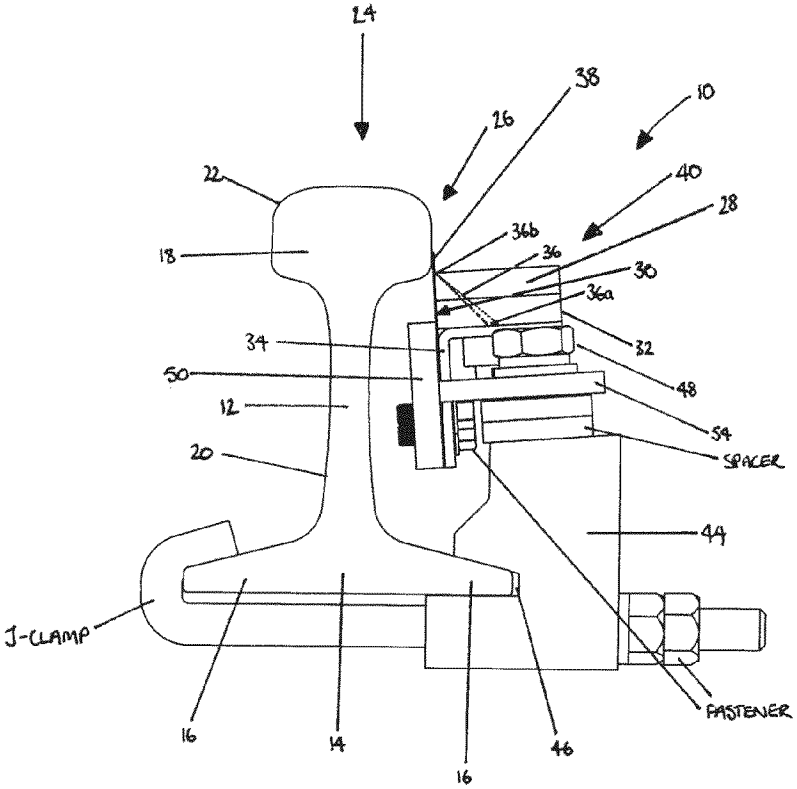
FIG. 1 is a side view of an applicator according to one embodiment of the present disclosure.

Referring to FIG. 1, one embodiment of a rail applicator assembly 10 is shown. The rail applicator assembly 10 may be mounted to a railroad rail 12 and includes an applicator 40 for applying a friction modifying material to a gauge face 26 of the rail 12. The rail 12 includes a base portion 14 with flanges 16 extending therefrom and a head portion 18 having a web portion 20, which extends between the head portion 18 and the base portion 14. The head portion 18 of the rail 12 has an outer surface 22 defining a crown 24, or top of rail and a gauge face surface 26. The applicator 40 is configured to apply friction modifying material to the gauge or inside surface 26 (hereafter the "gauge face") of the rail 12.

The applicator 40 includes a resilient pad 28, having a front surface 30 and a rear surface 32, a rail engagement element 38, and an applicator support 34 for supporting and attaching the applicator 40 to the rail 12, and for positioning and supporting the applicator 40 adjacent to the gauge face 26 of the rail 12.

Figure 3A:
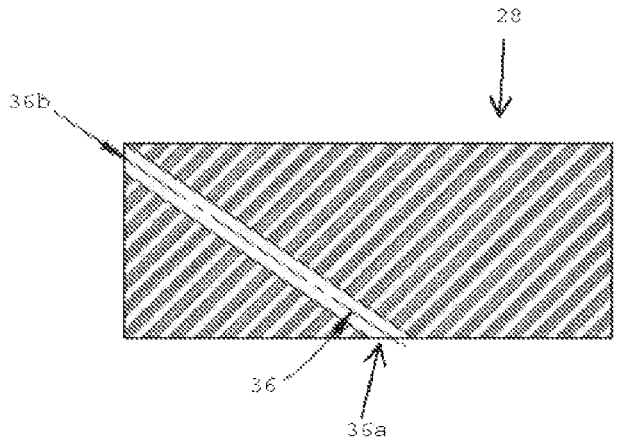
FIG. 3A shows an example of a cross section of a resilient pad. A non-limiting example of a channel within the resilient pad is also shown.

The resilient pad 28 is an elongate member generally having a rectangular shape, although other suitable shapes may be utilized for the pad 28. The pad 28 defines one or more than one channel 36 that extends through the pad 28 for the friction modifying material to flow from one or more than one inlet 36*a* to one or more than one outlet 36*b*. FIGS. 4A, 4B, 5A and 5B show examples of resilient pads comprising 4 (FIGS. 4A, B) or one channel (FIGS. 5A, B). The channel may be elongated along the length of the pad 28, so that the inlet 36*a* and outlet 36*b* are slot-shaped (see FIGS. 5A,B) The channel 36 may be directly formed in the pad 28. Alternatively, the channel 36 may be defined by a separate insert (not shown) positioned within the pad 28. The pad 28 may be constructed of any resilient material, for example but not limited to an open-cell neoprene foam, a polymeric material, rubber, stone wool, a closed-cell foam, or a combination of open-cell and closed-cell foam. For example, a profiled or shaped rubber pad, for example, a hollow rubber member having sufficient resiliency and flexibility may be used as the pad 28. Alternatively, the rubber member may comprise a preformed channel with a closure or valve member at the outlet. A cross section of an example of a resilient pad 28 in an uncompressed state comprising a channel 36 is shown in FIG. 3A. In the uncompressed state, channel 36 is open along the length of the channel from the inlet 36*a* to the outlet 36*b*.

Figure 3B:
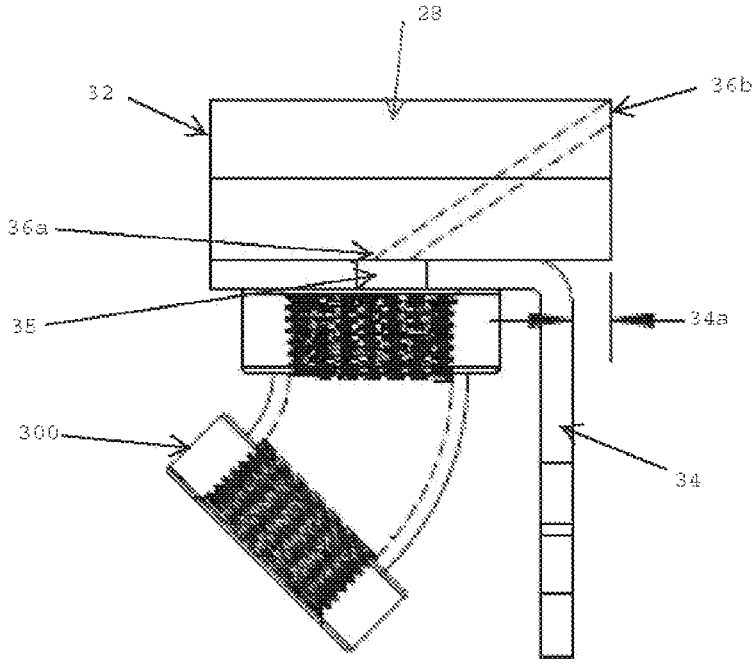
FIG. 3B shows a side view of several components of an example of an applicator, showing a non-limiting example of a resilient pad comprising a channel mounted onto one surface of a support, and a port mounted on a second surface of the support.

FIG. 3B shows several components of applicator 40 in a partially assembled state, including resilient pad 28 comprising one or more channels 36, mounted onto an upper surface of support 34. The resilient pad 28 may be glued onto support 34, or attached to support 34 via clips, or keys and with corresponding passageways or press-fit as would be known within the art. Inlet pipe 300, attached on the lower surface of the support 34, is also shown. Inlet pipe 300 is in fluid communication with opening 35 within support 34 and with channel 36. The free end of inlet pipe 300 is for attachment to a friction modifying material delivery system as is known in the art. The resilient pad 28 in FIG. 3B is shown in an uncompressed state with the back surface of the pad 30 extending beyond the back side of support 34, by an amount 34*a*.

Figure 7A:
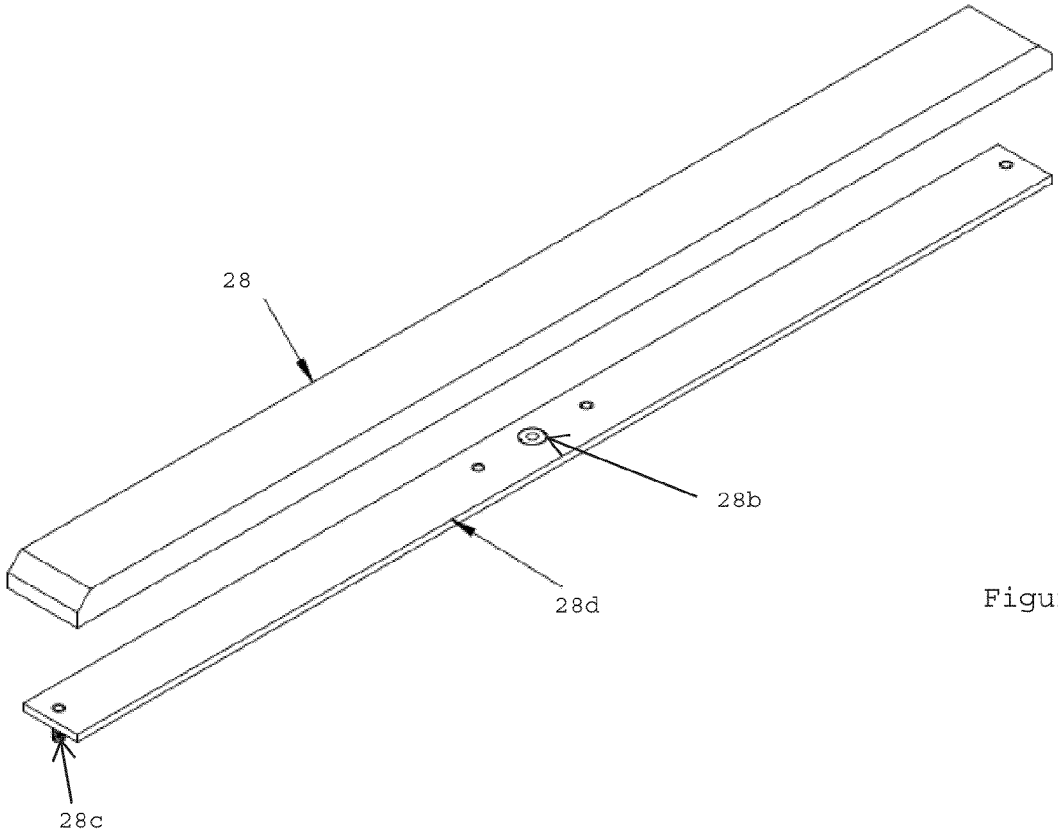
FIG. 7*a* shows an exploded perspective view of a resilient pad cassette including a resilient pad and attachment plate.
Figure 7B:
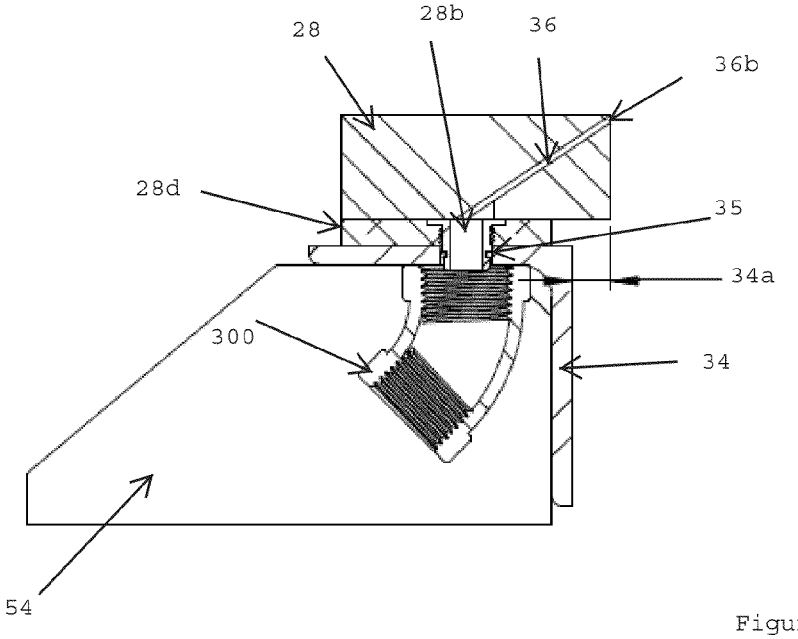
FIG. 7B shows a cross section of the resilient pad cassette of FIG. 7A mounted onto a support.

The resilient pad 28 may be removed from the applicator, and replaced, under field conditions if the resilient pad wears over time. This would involve removing the resilient pad 28 from the support 34, and re-attaching a new resilient pad to the support. For example, if the resilient pad is glued on the support directly, then the upper surface of the support is cleaned with a suitable solvent, an adhesive is applied to the surface(s) to be glued, and the resilient pad 28 reattached to the support while compressing the pad against the rail engagement element 38. If the pad is attached by clips, keys or by another mechanical attachment mechanism, then the pad may be removed and reinstalled using the same attachment mechanism while compressing the pad against the rail engagement element. Alternatively, a resilient pad cassette, comprising a resilient pad 28 glued, or otherwise attached, to an attachment plate 28*d* (see FIGS. 7A and 7B). The attachment plate 28*d* may be fastened, for example by bolts 28*c* into the support 34. The attachment plate 28*d* comprises one or more opening 28*b* in fluid communication with one or more channel 36. As shown in FIG. 7B, the width of resilient pad 28 is greater than that of attachment plate 28*d* so that when the assembly is mounted against rail engagement element 36, the resilient pad within the cassette may be compressed by amount 34*a*.

Figure 3C:
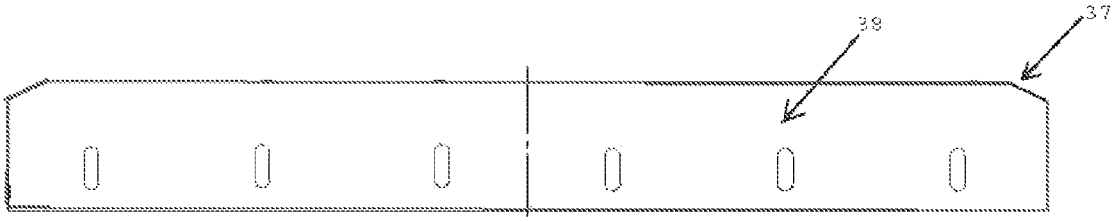
FIG. 3C shows a front view of a rail engagement element comprising openings for mounting the rail engagement element onto the support.

The rail engagement element 38 (see FIG. 3C), for example, a thin blade, is attached to an applicator support 34 (FIG. 1, 6A, 6B). The side surface of the rail engagement element 38 abuts the front surface 30 of the pad 28. An example of a rail engagement device 38 comprising one or more openings for mounting onto a support 34 is shown in FIG. 3C.

Figure 6A:
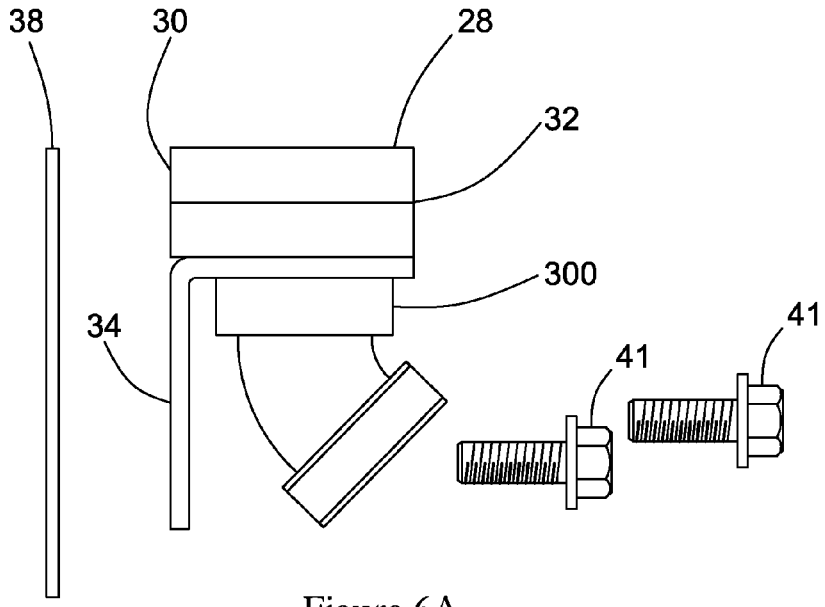
FIG. 6A shows a side exploded view of components of an example of an applicator, including a resilient pad, a rail engagement element, a support, port and mounting bolts.
Figure 6B:
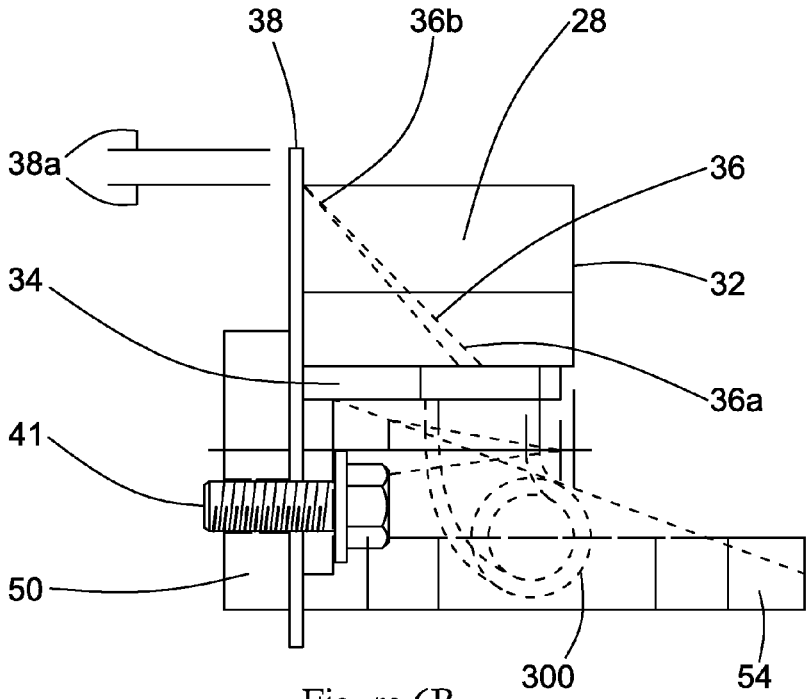
FIG. 6B shows a side view of a assembled applicator showing a non-liming example of a resilient pad comprising a channel, a rail engagement element, a support, and a port, mounted to a bar chassis.

The applicator support 34 may be attached to the rail 12 using any suitable mounting. For example as shown in FIGS. 1, and 6B, the applicator support 34 may be connected to a bar chassis 50 with fasteners 41.

When the applicator 40 is installed on a rail using support 50, the rail engagement elements or thin blade 38 extends upwards from the applicator support 34 and engages with the gauge face 26 of the rail. The rail engagement element 38 may be positioned to extend beyond the top surface of the resilient pad 28 (see 38*a* FIG. 6B). For example the rail engagement element 38 may extend beyond the top surface of the resilient pad 28 from between about 0.01 to about 50 mm or any amount therebetween. For example, the rail engagement element 38 may extend beyond the top surface of the resilient pad 28 from about 0.01 0.05, 1.0, 1.5, 2.0, 2.5, 5.0, 7.5, 10.0, 12.5, 15, 17.5, 20, 22.5 25, 27.5, 30, 35, 40, 45, and 50 mm or any amount therebetween.

The positioning of the rail engagement element beyond that of the top surface of the resilient pad may facilitate direction of the friction modifying material from each of the one or more outlets 36*b* to the gauge face surface of the rail 26. Furthermore by extending the rail engagement element 38 beyond the top surface of the resilient body 38, the resilient body 38 of the applicator 40 may be positioned at a location along the gauge face surface of the rail 26 that is lower (relative to the ground surface) than would otherwise be possible if the rail engagement element 38 was not present, while still effectively delivering friction modifying material to the gauge face surface 26.

The use of the rail engagement element 38 may also simplify mounting and adjustment of the assembled applicator 40 against rails that are worn and comprise worn gauge face 26 or top of rail 24 surfaces, while still achieving effective delivery of the friction modifying material to the gauge face of the rail with reduced waste.

Bar chassis 50 may comprise an extension 54 which extends away from the rail 12. The extension 54 connects the bar chassis to mounting clamp 44. Each applicator 10 may have more than one bar chassis 50 connected to more than one mounting clamp 44. For example, the bar chassis 50 may be mounted to the rail 12 through two mounting clamps 44. Each of the mounting clamps 44 has a recess 46 configured to receive the flange 16 of the rail 12. Each mounting clamp 44 also includes a bolt (not shown) having a J-shaped end configured to receive the flange 16 and a threaded end that passes through the mounting clamp 44.

The resilient pad 28 is attached to the applicator support 34 and abuts the rail engagement element 38, so that it is compressed against the rail engagement element 38. When the resilient pad is compressed, at least a portion of the one or more than one channel 36 is closed. For example, which is not to be considered limiting, as shown in FIG. 1, the one or more than one outlet 36*b* of the one or more than one channel may be closed. However, if desired, the length of the one or more than one channel 36, from the inlet 36*a* to the outlet 36*b* may be closed. The resilient pad may be compressed from between about 0.5% to about 20% of the width of the resilient pad, along a first width, a second width or a combination thereof, of the resilient pad. The width that is compressed may be the first width between one side surface, for example surface 32, to a second side surface, surface 30 of the resilient pad, the second width between a top surface to a bottom surface of the resilient body, or a combination thereof. For example, the resilient pad may be compressed from between about 0.5, 1.0, 2.0, 4.0, 6.0, 7.0, 8.0, 9.0, 10.0, 11.0, 12.0, 13.0, 14.0, 15.0, 16.0, 18.0, and 20% along the first width, second width, or a combination thereof.

It is also contemplated that resilient pad 28 may be mounted on support 34 and abutted against rail engagement element 38 in a way that the resilient pad is not compressed against the rail engagement element. In this example, the outlet 36*b* of resilient pad comprises a self closing valve, so that when the fluid pressure of the friction modifying material within channel 36 is low, the self closing valve is closed. The self closing valve would open with increased pressure within channel 36 permitting the friction modifying material to exit the channel. A self closing valve may be manufactured as part of the resilient pad, for example flaps along the upper surface of the resilient pad at the outlet 36*b*, or a self closing valve may be inserted within the outlet 36*b*, for example, press fit or snap fit into the resilient pad 36 at outlet 36*b*.

Figure 2:
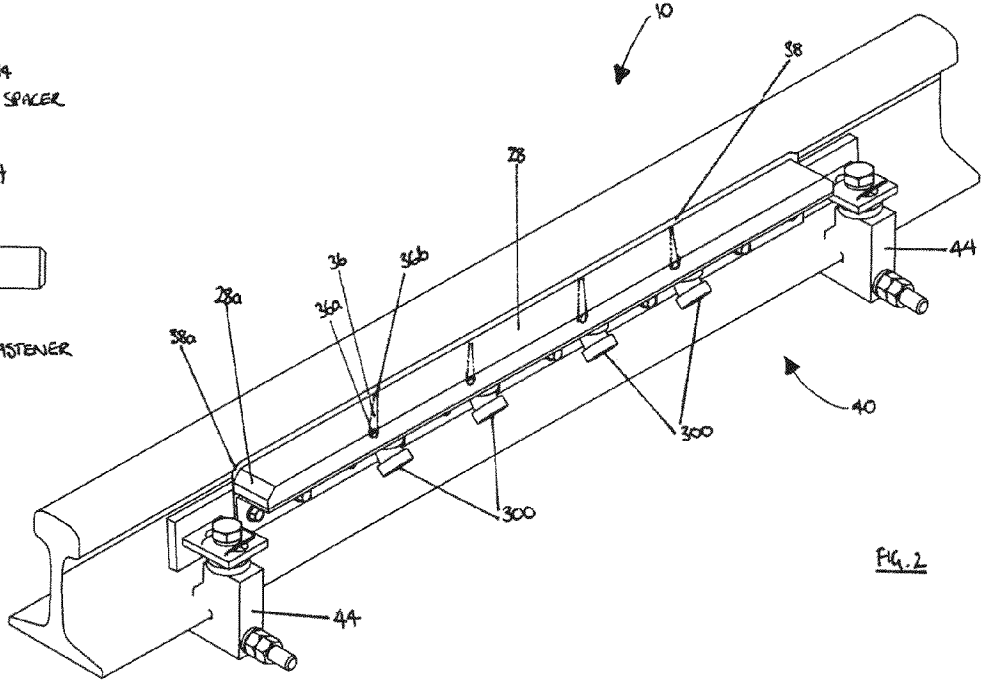
FIG. 2 is a perspective view of the applicator of FIG. 1.

The resilient foam bar may comprise, for example from between 1 to about 24 or any amount therebetween of channels, inlets, outlets, or any combination thereof. For example 1, 2, 4, 6, 8, 10, 12, 14, 16, 18, 20, 22, 24 channels, inlets, outlets, or any combination thereof. FIGS. 2, 4C and 4D shows an example of an assembled applicator mounted on support 50 comprising four inlet pipes 300. FIGS. 5C and 5D show an assembled applicator mounted on support 50 comprising one inlet pipe 300

In operation a pump (not shown) is activated and impels friction modifying material through the flow channel 36 from the inlet 36*a* to the outlet 36*b*. The friction modifying material is delivered to the pad 28 and rail engagement device 38 for application on the gauge face 26 of the rail 12. Once the pump is deactivated the fluid pressure within one or more of the one or more than one channel 36 decreases and one or more than one of the channel 36 closes reducing the chance of contamination or clogging.

The pad 28 is secured to the upper surface of the applicator support 34. For example, the pad 28 may be directly formed on or bonded to the applicator support 34. The applicator 40 and applicator support 34 may be mounted to rail 12 for example using mounting clamps 44. In this example, each of the mounting clamps 44 comprises a recess 46 configured to receive the flange 16 of the rail 12. However, other mounting systems may be used if desired.

FIG. 2 shows a perspective view of the rail applicator assembly 10 of FIG. 1, the applicator 40 includes the pad 28 and the rail engagement element 38. The corner of the pad 28 is canted 28*a*. The corner of the rail engagement element 38 is also canted 38*a*. This allows the pad 28 and the rail engagement element 38 to engage the train wheel (not shown) with a lower risk of damage ensuing. There are two mounting clamps 44. Also shown are four inlet pipes 300 which are in fluid communication with the inlet 36*a* to the flow channel 36.

It is contemplated that any embodiment discussed in this specification can be implemented or combined with respect to any other embodiment, method, composition or aspect of the invention, and vice versa.

Unless defined otherwise, all technical and scientific terms used herein have the same meaning as is commonly understood by one of ordinary skill in the art to which this invention belongs. Unless otherwise specified, all patents, applications, published applications and other publications referred to herein are incorporated by reference in their entirety. If a definition set forth in this section is contrary to or otherwise inconsistent with a definition set forth in the patents, applications, published applications and other publications that are herein incorporated by reference, the definition set forth in this section prevails over the definition that is incorporated herein by reference. Citation of references herein is not to be construed nor considered as an admission that such references are prior art to the present invention.

Use of examples in the specification, including examples of terms, is for illustrative purposes only and is not intended to limit the scope and meaning of the embodiments of the invention herein. Numeric ranges are inclusive of the numbers defining the range. In the specification, the word "comprising" is used as an open-ended term, substantially equivalent to the phrase "including, but not limited to," and the word "comprises" has a corresponding meaning.

The invention includes all embodiments, modifications and variations substantially as hereinbefore described and with reference to the examples and figures. It will be apparent to persons skilled in the art that a number of variations and modifications can be made without departing from the scope of the invention as defined in the claims. Examples of such modifications include the substitution of known equivalents for any aspect of the invention in order to achieve the same result in substantially the same way.

The invention claimed is:

1. A rail gauge face applicator comprising:

a resilient pad comprising one or more than one flow channel extending from one or more than one inlet to one or more than one outlet;

a rail engagement element abutting a side surface of the resilient pad;

the one or more than one flow channel operable from a closed position when a flow pressure within the one or more than one channel is low to an open position when the flow pressure is raised;

wherein the resilient pad is compressed against the rail engagement element such that the compression maintains the one or more outlet in the closed position until the pressure in the one of more flow channel is raised.

2. The rail gauge face applicator of claim 1, wherein the resilient pad is compressed against the rail engagement element such that the compression maintains substantially a length of each of the one or more than one channel in the closed position until the pressure in the flow channel is raised.

3. The rail gauge face applicator of claim 1, wherein the resilient pad has at least one chamfered corner.

4. The rail gauge face applicator of claim 1, wherein the rail engagement element extends from a top surface of the resilient pad by about 0.1 to about 50 mm.

5. The rail gauge face applicator of claim 1, wherein the rail engagement element is an elongated thin blade.

6. The rail gauge face applicator of claim 1, further comprising an applicator support wherein the resilient pad is secured to the applicator support.

7. The rail gauge face applicator of claim 1, further comprising an applicator support wherein the resilient body and the rail engagement element is secured to the applicator support.

8. The rail gauge face applicator of claim 1, wherein the one or more than one channel inlet is located on a bottom surface of the resilient pad and the one or more than one outlet is located on a top surface adjacent the rail engagement element, or a side surface adjacent the top surface and adjacent the rail engagement element, of the resilient pad.

9. The rail gauge face applicator of claim 1, wherein the one or more than one channel is angled toward the rail engagement element.

10. The rail gauge face applicator of claim 1, wherein the one or more than one outlet is substantially slot-shaped.

11. The rail gauge face applicator of claim 1, wherein the one or more than one outlet is substantially circular.

12. The rail gauge face applicator of claim 1, comprising from 1 to 6 outlets.

13. A method of applying friction modifying material to a gauge face surface of a rail, comprising:

providing the gauge face applicator of claim 1;

engaging the gauge face surface with the rail engagement element; and applying friction modifying material to the gauge face surface by raising the pressure in the one or more than one channel causing the one or more than one channel to open and the friction modifying material to be distributed to the rail engagement element.

14. A rail applicator assembly comprising:

a rail having a head portion, a base portion, and web portion extending between the head portion and the base portion, the head portion defining an outer surface;

an applicator according to claim 1 wherein the rail engagement element engages outer surface of the rail head.

15. A method of replacing a resilient pad of the gauge face applicator of claim 1, comprising:

removing the resilient pad from the rail engagement element and an applicator support;

installing a resilient pad cassette comprising a replacement resilient pad attached to an attachment plate, by compressing the resilient pad against the rail engagement element, and attaching the attachment plate to the applicator support thereby replacing the resilient pad.

* * * * *